US006152322A

United States Patent [19]

Marino

[11] Patent Number: 6,152,322

[45] Date of Patent: Nov. 28, 2000

[54] CAP FOR MOIST TISSUE DISPENSERS

[76] Inventor: Michael Marino, R.D. #8, Box 801, Rte. 422 West, New Castle, Pa. 16101

[21] Appl. No.: 09/265,145

[22] Filed: Mar. 8, 1999

[51] Int. Cl.[7] ..... B65H 1/00

[52] U.S. Cl. ..... 221/63; 206/812

[58] Field of Search ..... 221/33, 45, 63, 221/62, 307, 308, 310; 206/449, 812, 409

[56] References Cited

U.S. PATENT DOCUMENTS 3,967,756 7/1976 Barish .
3,973,695 8/1976 Ames .
3,982,659 9/1976 Ross .
4,328,907 5/1982 Beard .
5,542,567 8/1996 Julius .

*Primary Examiner*—Kenneth W. Noland
*Attorney, Agent, or Firm*—Harpman & Harpman

[57] ABSTRACT

A cap for use on containers to selectively dispense individual pre-moistened tissues from a web of perforated tissues. The cap is removably secured to a container body having a top portion with a depending annular flange on its peripheral edge and a dispensing recess centered within. An integral access lid extends from the top portion for sealing registration over the dispensing recess. A dispensing outlet is formed within the dispensing recess through which the tissues may be removed.

8 Claims, 4 Drawing Sheets

CAP FOR MOIST TISSUE DISPENSERS

BACKGROUND OF THE INVENTION

1. Technical Field

This invention relates to closure caps for dispensers of pre-moistened tissues that are selectively dispensed from a resealable container.

2. Description of Prior Art

Prior art devices of this type are typically directed towards complete dispenser constructions having a container for the storage of the plurality of pre-moistened towels and tissues that are in an interconnected band defined by preparation so as to be individually separated, removed from use as they are dispensed. Examples of such containers can be seen in U.S. Pat. Nos. 3,967,756, 3,973,695, 3,982,659, 4,328,907 and 5,542,567.

In U.S. Pat. No. 3,967,756 a wet wipe dispenser can be seen having a bottom loading container with a molded integral top.

U.S. Pat. No. 3,973,695 is directed towards a dispenser for moist tissues having a container and a cap removably secured thereto. A shallow dispensing groove is formed within the cap having a lid registerable thereon.

U.S. Pat. No. 3,982,659 discloses a bulk package for wet sheets having a mounting base removably secured to one piece molded container body. Closure dispensing unit is secured with an outlet opening in the container having multiple hinged flanges over an hour glass shaped opening.

U.S. Pat. No. 4,328,907 is on a dispenser for individual moistened paper tissues having a container body with a dispensing cap removably secured thereon. The cap has an upstanding tapered wall with a recessed area and a hinge closure cap engageable thereover.

Finally, U.S. Pat. No. 5,542,567 claims a moist tissue package construction having a storage box base and a registering lid thereon. The lid has a recessed dispensing area with an upstanding slit outlet within. A hinged cap is registerable over the dispensing area.

SUMMARY OF THE INVENTION

A cap for a container to dispense individual pre-moistened tissues. The cap has a depending annular flange from a top portion with a central receiving well formed within. An integral hinged lid extends from the top portion and is registerable over the recessed well within. An access tab extends from the lid over a secondary recessed area to afford engagement and opening of the lid from the surrounding top portion.

DESCRIPTION OF THE PREFERRED EMBODIMENT

Figure 1:
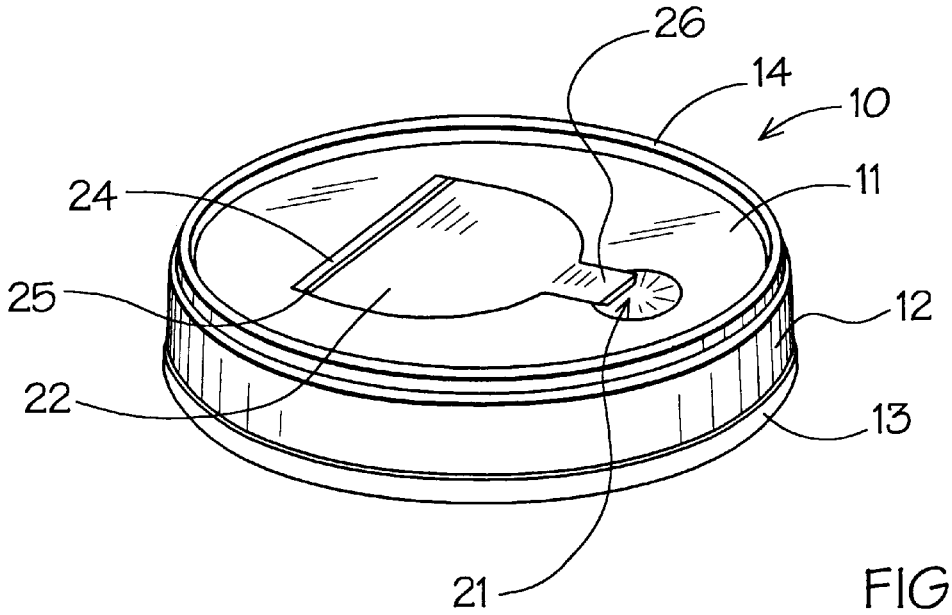
FIG. 1 is a perspective elevation of the cap of the present invention.
Figure 2:
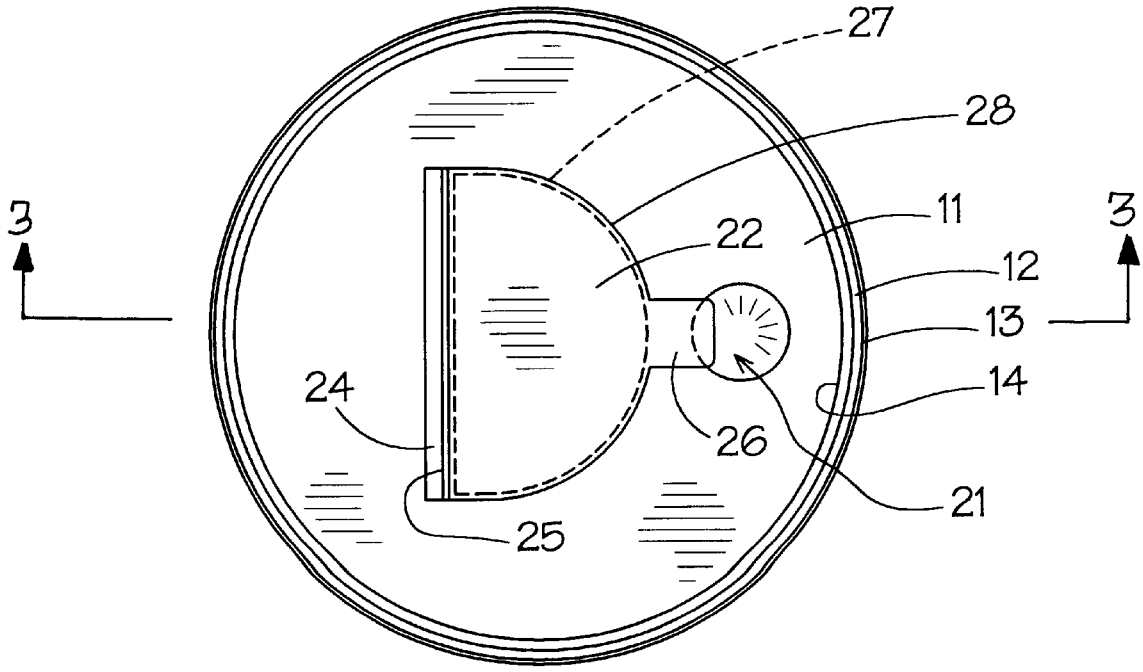
FIG. 2 is a top plan view of the cap of the invention in closed access position.
Figure 3:
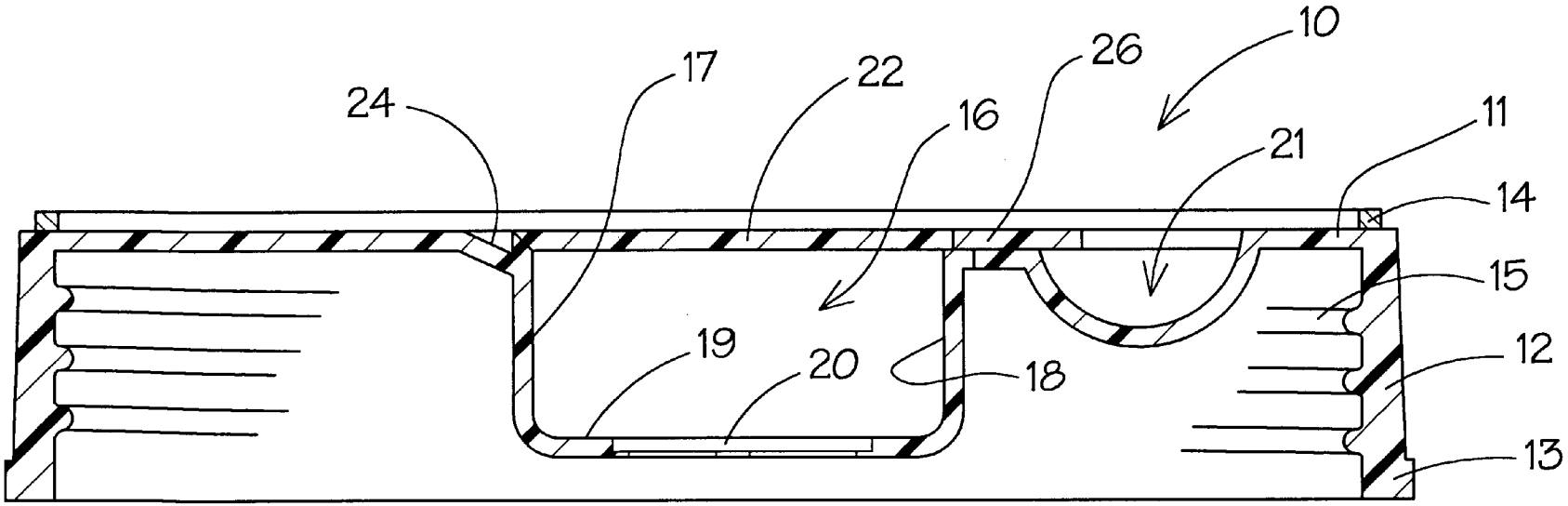
FIG. 3 is an enlarged vertical cross-sectional view on lines 3—3 of FIG. 2.

This invention is directed to a new and improved dispensing cap for dispensing containers. Referring to FIGS. 1, 2 and 3 of the drawings, a cap 10 can be seen having a top portion 11 with a depending annular flange 12 on the periphery thereof. The lower portion of the depending annular flange 12 has a lower annular outwardly offset secondary flange 13 defining the base of the cap 10. The top portion 11 has an upstanding annular flange 14 inwardly of the peripheral edge thereof. The depending annular flange 12 has a plurality of interior engagement threads 15 formed thereon as will be well known by those skilled in the art.

Figure 8:
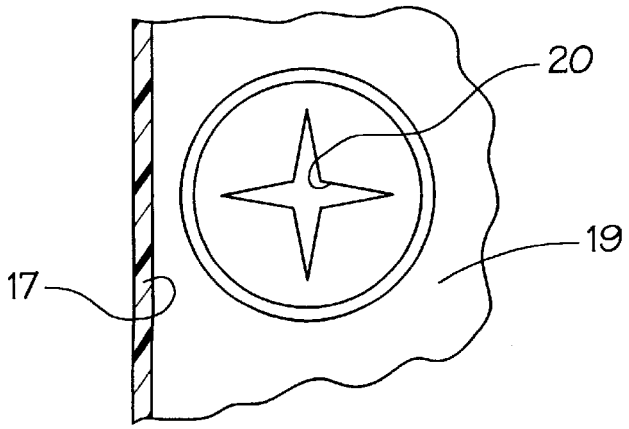
FIG. 8 is an enlarged partial cross-sectional view on lines 8—8 of FIG. 4.

The top portion 11 has a contoured dispensing recessed area 16 formed within having a main hinge support sidewall 17 with an arcuate sidewall 18 and an integral bottom 19 extending therefrom. The bottom 19 has a modified star shaped opening at 20 within as best seen in FIG. 8 of the drawings.

Figure 4:
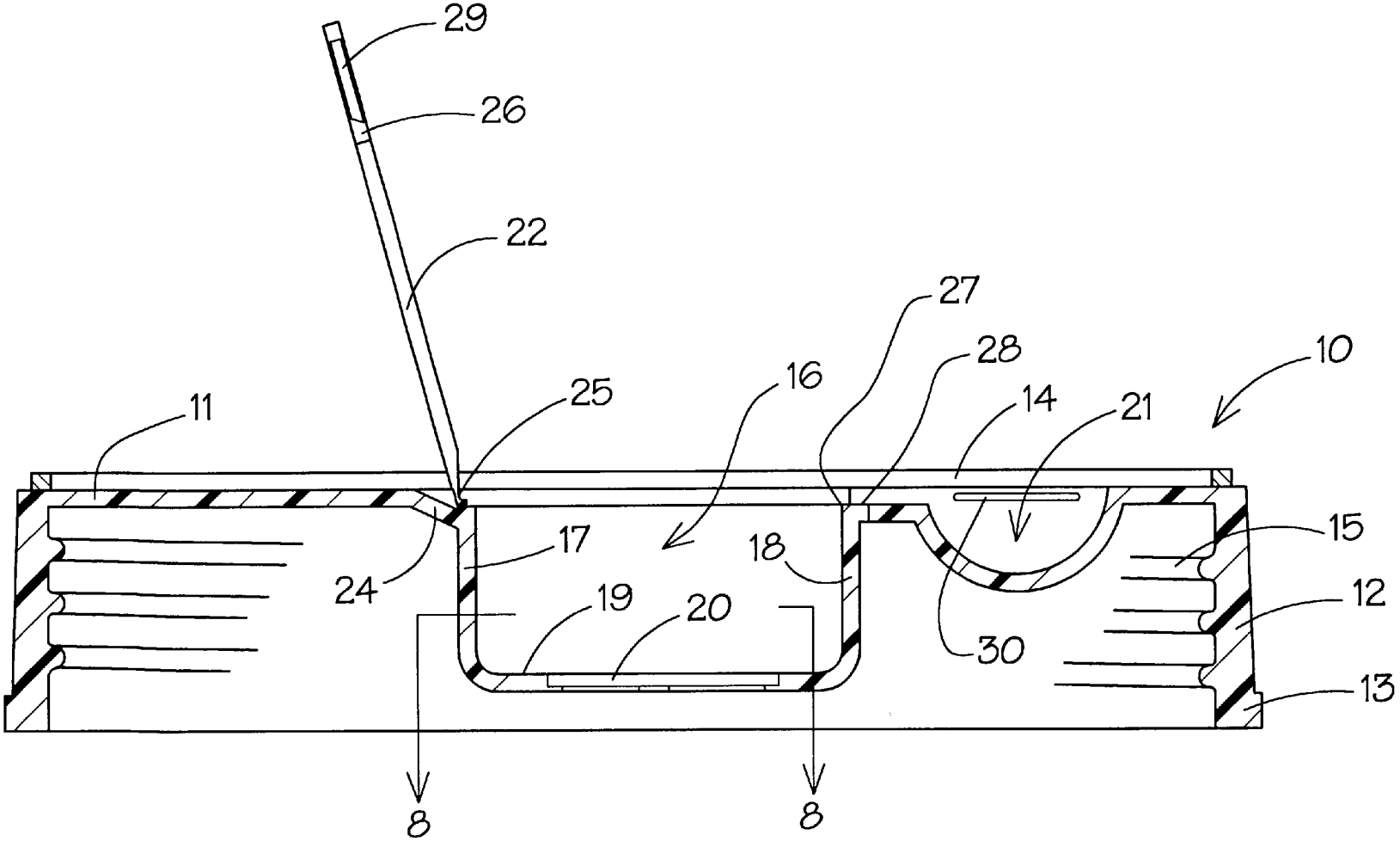
FIG. 4 is an enlarged cross-sectional view of the invention in open position.
Figure 5:
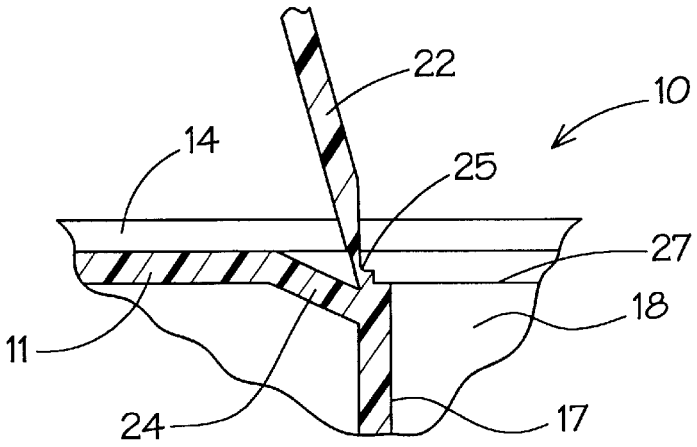
FIG. 5 is an enlarged cross-section of the living hinge portion of the invention shown in FIG. 4 of the drawings.

A secondary recessed area 21 is formed within the top portion 11 adjacent the dispensing recess area 16 as best seen in FIGS. 2, 3 and 4 of the drawings.

A closure lid 22 for the dispensing recess area 16 extends integrally from the hinge support wall 17 by a living hinge 23 formed therebetween. A portion of the top portion 11 abutting the hinge support wall 17 extends angularly at 24 from the top portion 11 to provide clearance and assist production formation of the integral living hinge 25. The closure lid 22 has an engagement access tab 26 extending therefrom that extends beyond the recess area 16 overlying a portion of the secondary recess 21 when in closed position as best seen in FIGS. 1, 2 and 3 of the drawings. A lid engagement shoulder 27 is formed around an upper perimeter edge 28 of the arcuate sidewall 18 illustrated in solid lines in FIG. 4 and in broken lines in FIG. 1 of the drawings.

Figure 6:
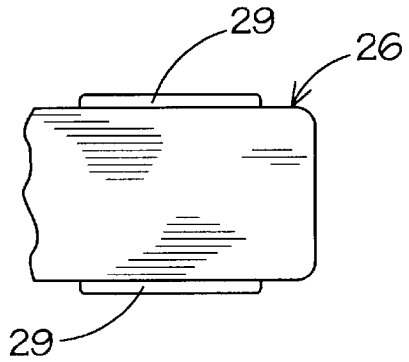
FIG. 6 is an enlarged top plan view of the engagement tab portion of the invention.
Figure 7:
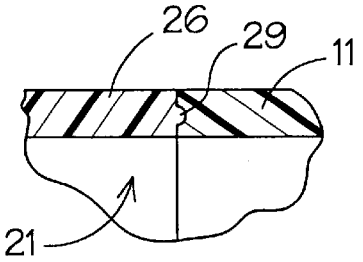
FIG. 7 is an enlarged cross-sectional view of the registering lip portion of the engagement tab.

Referring now to FIGS. 4, 6 and 7 of the drawings, the access tab 26 as hereinbefore described can be seen having oppositely disposed slide latches 29 formed thereon engageable into registering areas at 30 in the adjacent top portion 11 between the respective recess areas 16 and 21.

It will be evident from the above description that upon closing the lid 22, it is recessed flush within the surrounding surface of the top portion 11 and that to open the lid 22 the access tab portion 26 is grasped by the user, not shown, and lifted up from the secondary recess area 21. Further that upon closure of the lid 22 the slide latches 29 on the tab extension portion 26 are registerably engaged within a portion of the top 11 and overlies the secondary recess area 21 with the registration of the lid 22 on the shoulder 27 that extends about the main recess area 16.

It will be apparent that a new and useful closure cap for the dispensing of moist tissues has been illustrated and described and that various changes and modifications may be made thereto without departing from the spirit of the invention.

Therefore I claim:

1. A dispensing cap comprising a top portion having a depending annular flange on its peripheral edge, a first recess area within said top portion, said recessed area having a hinge support wall and an integral bottom extending therefrom, a closure lid extending from said hinge support wall, a living hinge interconnecting said closure lid and said hinge support wall, an access tab extending from said lid opposite said hinge, a secondary recessed area within said top portion in spaced relation to said first recess area, said closure lid registerable within a portion of said secondary recess area, means for selectively locking said closure lid over said respective recess openings, means for sealing said closure lid within said first recess area and means for receiving the hinge portion of said lid in planar relation to said top portion.

2. The dispensing cap as set forth in claim 1 wherein an upstanding annular flange is formed on the perimeter edge of said top portion.

3. The dispensing cap set forth in claim 1 wherein a secondary offset flange extends from the lower portion of said annular depending flange.

4. The dispensing cap set forth in claim 1 wherein said first recess portion has an arcuate sidewall extending integrally from said hinge support wall and said integral bottom.

5. The dispensing cap set forth in claim 1 wherein said first recess portion is of a known interior diameter and said second recess portion is of an interior diameter less than that of said first recess area.

6. The dispensing cap set forth in claim 1 wherein said means for selectively locking said closure lid over said first and second recess areas comprises; a tab portion extending from said closure lid, slide latches on said tab extension engageable with said registerable top portion.

7. The dispensing cap set forth in claim 1 wherein said means for sealing said closure lid within said first recess opening comprises; a shoulder about the perimeter edge of said first recess area.

8. The dispensing cap set forth in claim 1 wherein said means for receiving the hinge portion of said closure lid in planar relation to said top portion comprises; an angular extending portion of said top portion abutting said hinge portion.

* * * * *